US008203515B2

(12) United States Patent
Mori

(10) Patent No.: US 8,203,515 B2
(45) Date of Patent: Jun. 19, 2012

(54) IMAGE DISPLAY DEVICE, IMAGE DISPLAY METHOD, IMAGE DISPLAY PROGRAM, RECORDING MEDIUM CONTAINING IMAGE DISPLAY PROGRAM, AND ELECTRONIC APPARATUS

(75) Inventor: Kenji Mori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 857 days.

(21) Appl. No.: 11/866,799

(22) Filed: Oct. 3, 2007

(65) Prior Publication Data

US 2008/0180373 A1 Jul. 31, 2008

(30) Foreign Application Priority Data

Oct. 27, 2006 (JP) ..... 2006-292571

(51) Int. Cl.
*G09G 3/36* (2006.01)

(52) U.S. Cl. ..... 345/89; 345/102; 345/77; 345/690; 345/204; 362/97.3

(58) Field of Classification Search ..... 345/102, 345/76–83, 204, 690; 362/97.1–97.3
See application file for complete search history.

(56) References Cited

U.S. PATENT DOCUMENTS

| | | | | |
|---|---|---|---|---|
| 7,167,150 | B2 * | 1/2007 | Yang et al. | 345/89 |
| 7,530,695 | B2 | 5/2009 | Furihata | |
| 7,595,784 | B2 * | 9/2009 | Yamamoto et al. | 345/102 |
| 7,969,408 | B2 * | 6/2011 | Yamamoto | 345/102 |
| 2002/0021292 | A1 * | 2/2002 | Sakashita | 345/204 |
| 2003/0201968 | A1 | 10/2003 | Itoh et al. | |
| 2004/0247199 | A1 * | 12/2004 | Murai et al. | 382/274 |
| 2006/0055894 | A1 * | 3/2006 | Furihata | 353/85 |
| 2006/0274026 | A1 * | 12/2006 | Kerofsky | 345/102 |
| 2008/0129679 | A1 * | 6/2008 | Yamamoto | 345/102 |
| 2008/0143756 | A1 * | 6/2008 | Yamamoto et al. | 345/690 |

FOREIGN PATENT DOCUMENTS

| | | |
|---|---|---|
| CN | 1746764 A | 3/2006 |
| JP | A 11-65528 | 3/1999 |
| JP | A 2004-004532 | 1/2004 |
| JP | A 2004-282377 | 10/2004 |
| JP | A 2004-310671 | 11/2004 |
| JP | A 2006-308631 | 11/2006 |
| JP | A 2006-308632 | 11/2006 |

OTHER PUBLICATIONS

Apr. 26, 2011 Chinese Office Action issued in corresponding Chinese Application No. 200710167465.6.

* cited by examiner

*Primary Examiner* — Lun-Yi Lao
*Assistant Examiner* — Kelly B Hegarty
(74) *Attorney, Agent, or Firm* — Oliff & Berridge, PLC

(57) ABSTRACT

An image display device corrects image data, which are used for displaying an image, using a gray scale value assigned to each pixel and also controls a source light luminance of a light source. The image display device includes a scene change detection device, an image correction device, a source light luminance control device, and a time characteristic control device. The scene change detection device detects a change of scene of the input image data. The image correction device corrects the image data. The source light luminance control device controls the source light luminance. The time characteristic control device changes a first time characteristic of a change in the source light luminance and a second time characteristic of an image correction amount by which the image data are corrected on the basis of the change of scene and executes a process on the basis of the first time characteristic and the second time characteristic.

14 Claims, 10 Drawing Sheets

IMAGE DISPLAY DEVICE, IMAGE DISPLAY METHOD, IMAGE DISPLAY PROGRAM, RECORDING MEDIUM CONTAINING IMAGE DISPLAY PROGRAM, AND ELECTRONIC APPARATUS

BACKGROUND

1. Technical Field

The present invention relates to an image display device, an image display method, an image display program a recording medium containing the image display program, and an electronic apparatus, which execute a process on input image data.

2. Related Art

In an existing image display device, such as a laptop computer, that uses a non-luminescent display device, such as a liquid crystal panel, when electric power is not supplied from the outside, image display is performed in such a manner that a light source (for example, cold-cathode tube) converts electric power supplied from a battery to light and the amount of light transmitted through the liquid crystal panel is then controlled. In general, of electric power consumed in the whole device, a percentage of electric power consumed by the light source is relatively large. Then, during battery driving, electric power consumed by the device is reduced by reducing the amount of light emitted from the light source (hereinafter, referred to as "the amount of source light").

Here, when the amount of source light is controlled in a case where the amount of source light steeply varies, it has been known that a display screen flickers (hereinafter, referred to as "flicker"). In order to prevent such a flicker, the following technologies have been proposed. Japanese Unexamined Patent Application Publication No. 11-65528 describes a technology that attempts to reduce power consumption by light control and expand a dynamic range, white moderating a change in maximum value of an image by a high-frequency cut filter in order to prevent a flicker due to the light control. In addition, Japanese Unexamined Patent Application Publication No. 2004-4532 describes a technology that changes a light source control characteristic on the basis of the result of comparison between an input video signal and the previous output signal. Other than the above, Japanese Unexamined Patent Application Publication No. 2004-282377 describes a technology related to the invention.

However, in the technology described in the above JP-A-11-65528, the rate of change in light control is not dependent on a change of scene in a screen image, so that there is a possibility that, when there is no change of scene, a change due to light control is easily noticed or, on the other hand, when a change of scene is steep, light control is not able to follow the change. In addition, in the technology described in JP-A-2004-4532, because the control characteristic of a light source is set the same as the control characteristic of a video signal, there is a possibility that the light source and the screen image are visually not optimized. Furthermore, in the technology described in JP-A-2004-282377, it is difficult to appropriately suppress a flicker due to light control.

SUMMARY

An advantage of some aspects of the invention is that it provides an image display device, an image display method, an image display program, a recording medium containing an image display program, and an electronic apparatus, which are able to appropriately suppress a flicker produced in a display image when backlight dimming for power saving and image correction for compensating for the dimming.

A first aspect of the invention provides an image display device. The image display device corrects image data, which are used for displaying an image, using a gray scale value assigned to each pixel and al so controls a source light luminance of a light source. The image display device includes a scene change detection device, an image correction device, a source light luminance control device, and a time characteristic control device. The scene change detection device detects a change of scene of the input image data. The image correction device corrects the image data. The source light luminance control device controls the source light luminance. The time characteristic control device changes a first time characteristic of a change in the source light luminance and a second time characteristic of an image correction amount by which the image data are corrected on the basis of the change of scene and executes a process on the basis of the first time characteristic and the second time characteristic.

The image display device appropriately corrects image data, which are used for displaying an image, using a gray scale value assigned to each pixel and also controls the source light luminance of a light source (hereinafter, also termed as light control). The scene change detection device detects a change of scene (scene change) of the image data. The image correction device corrects the image data. The source light luminance control device controls the source light luminance. The time characteristic control device changes a first time characteristic of a change in the source light luminance and a second time characteristic of an image correction amount on the basis of the change of scene and then executes a process on the basis of the first time characteristic and the second time characteristic. According to the above image display device, because the time characteristics used respectively for the source light luminance and the image correction amount are changed in response to a change of scene of a video image, it is possible to effectively suppress the occurrence of a flicker or a delayed response when backlight dimming for power saving and image correction for compensating for the dimming are executed. Thus, it is possible to display an image with high quality.

In the image display device, the time characteristic control device may set the first time characteristic and the second time characteristic so that the first time characteristic differs from the second time characteristic. This is because, when a change in the source light luminance is compared with a change in the image correction amount, the change in source light luminance is visually easily recognized because of a change in white point (and black), while the change in the image correction amount is hardly recognized because of a change in halftone.

In the above image display device, the time characteristic control device may set the first time characteristic and the second time characteristic so that a chance in the source light luminance is slower in terms of time than a change in the image correction amount. In this manner, it is possible to prevent a flicker due to a change in white point for the source light luminance, and it is possible to ensure a quick response to a change of scene of a dynamic image while preventing a flicker for the image correction amount. Thus, it is possible to further effectively improve a flicker and a response.

In the above image display device, the time characteristic control device may execute filtering on the source light luminance for each frame using the first time characteristic as a filter coefficient and execute filtering on the image correction amount for each frame using the second time characteristic as a filter coefficient.

In the above image display device, the time characteristic control device may execute filtering on the source light luminance for each frame on the basis of the first time characteristic, calculate an image correction amount for each frame using the source light luminance that is filtered on the basis of the first time characteristic, and execute filtering on the calculated image correction amount on the basis of the second time characteristic. In this manner, because the image correction amount is calculated from the filtered source light luminance, it is possible to appropriately suppress breaking a relationship between light control and image correction. Hence, it is possible to display an image with high quality.

In the above image display device, the time characteristic control device may include a filter computing circuit and a switching device. The filter computing circuit executes filtering. The switching device switches input/output signals of the filter computing circuit and filter coefficients, which are used by the filter computing circuit. The time characteristic control device may execute the switching by means of the switching device, so that filtering on the source light luminance and filtering on the image correction amount are time sequentially executed in the filter computing circuit.

In this case, the filter computing circuit not only serves as a circuit that executes filtering on the source light luminance but also serves as a circuit that executes filtering on the image correction amount to sequentially execute filtering. Specifically, filters respectively for he source light luminance and the image correction amount are integrated (that is, formed of a single circuit) to switch input/output signals and filter coefficients. In this manner, it is possible effectively reduce circuit size.

In addition, the above image display device may be applied to an electronic apparatus provided with a power supply unit that supplies the image display device with voltage.

A second aspect of the invention provides an image display method that corrects image data, which are used for displaying an image, using a gray scale value assigned to each pixel and that also controls a source light luminance of a light source. The image display method includes detecting a change of scene of the input image data, correcting the image data, controlling the source light luminance, changing a first time characteristic of a change in the source light luminance and a second time characteristic of an image correction amount by which the image data are corrected on the basis of the change of scene and then executing a process on the basis of the first time characteristic and the second time characteristic.

A third aspect of the invention provides an image display program that executes a process to correct image data, which are used for displaying an image, using a gray scale value assigned to each pixel and that also executes a process to control a source light luminance of a light source. The image display program includes instructions for causing a computer to detect a change of scene of the input image data, correct the image data, control the source light luminance, and change a first time characteristic of a change in the source light luminance and a second time characteristic of an image correction amount by which the image data are corrected on the basis of the change of scene and then execute a process on the basis of the first time characteristic and the second time characteristic.

According to the above described image display method and image display program as well, because the time characteristics respectively used for the source light luminance and the image correction amount are changed in response to a change of scene of a video image, it is possible to effectively suppress the occurrence of a flicker and/or a delayed response.

Note that various computer readable media, such as a flexible disk, a CD-ROM, or an IC card, may be used as a recording medium that contains the image display program.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will now be described with reference to the accompanying drawings.

First Embodiment

A first embodiment of the invention will be described with reference to the drawings.

General Configuration

Figure 1:
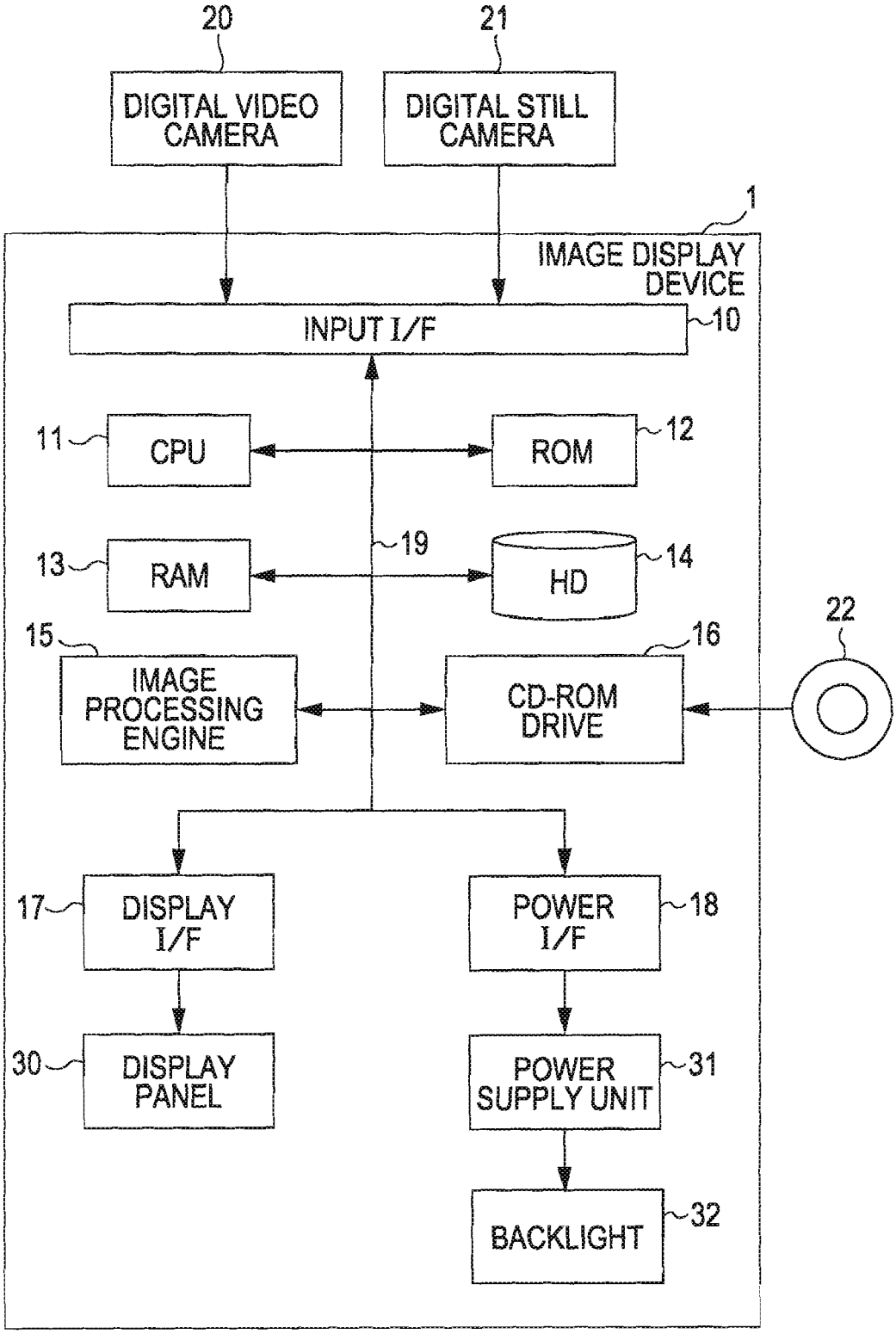
FIG. 1 is a block diagram that schematically shows an image display device according to an embodiment of the invention.

FIG. 1 is a block diagram that shows a hardware configuration of an image display device according to a first embodiment. As shown in FIG. 1, the image display device includes an input interface (hereinafter, referred to as "input I/F") 10, a CPU 11 a ROM 12, a RAM 13, a hard disk (hereinafter, referred to as "HD") 14, an image processing engine 15, a CD-ROM drive 16, a display Interface (hereinafter, referred to as "display I/F") 17, and a power I/F 18. These components are connected with each other through a bus 19. In addition, a display panel 30 is connected to the display I/F 17, and a power supply unit 31 is connected to the power I/F 18. Note that a specific example of the image display device 1 may be a laptop computer, a projector, a television, a mobile telephone, and the like, which are able to display an image using the display panel 30. Furthermore, the image processing engine 15 may be arranged not in a main bus but in an exclusive bus between an image input (I/O of the CPU, DMA from communication/external device, or the like) and an image output.

A digital video camera 20, a digital still camera 21, or the like, is connected to the input I/F 10 as a device that inputs a dynamic image. In addition, images distributed through a network device, images distributed through radio wave, and the like, are also input through the input I/F 10 to the image display device 1.

The CPU 11 is a section that controls various processes executed in the image display device 1. Particularly, when dynamic image data are input through the input I/F 10 or dynamic images stored in the HD 14 are reproduced, the CPU 11 transfers dynamic image data to the image processing engine 15 and then instructs the image processing engine 15 to display the dynamic image.

The power supply unit 31 supplies electric power stored in a battery that is set inside the power supply unit 31 or electric power supplied from the outside of the image display device 1, to various components, including a backlight 32, of the image display device 1.

The backlight 32 is a light source, such as a cold-cathode tube or an LED (light emitting diode), that converts electric power, which is supplied from the power supply unit 31, to light. Light emitted from the backlight 32 is diffused by various sheets interposed between the backlight 32 and the display panel 30 and is irradiated toward the display panel 30 as substantially uniform light.

The display panel 30 is a transmissive liquid crystal panel. The display panel 30 modulates light in accordance with a driving signal corresponding to image data that are input through the display I/F 17 and controls a transmittance ratio of the amount of light that is received from the backlight 32 to the amount of light that is transmitted through the display panel 30 for each pixel. Thus, the display panel 30 displays a color image. Note that, because the display panel 30 performs display by controlling a transmittance ratio of light, the luminances of an image which will be displayed vary in proportion to the amount of light supplied from the backlight 32.

Configuration of Image Processing Engine

Figure 2:
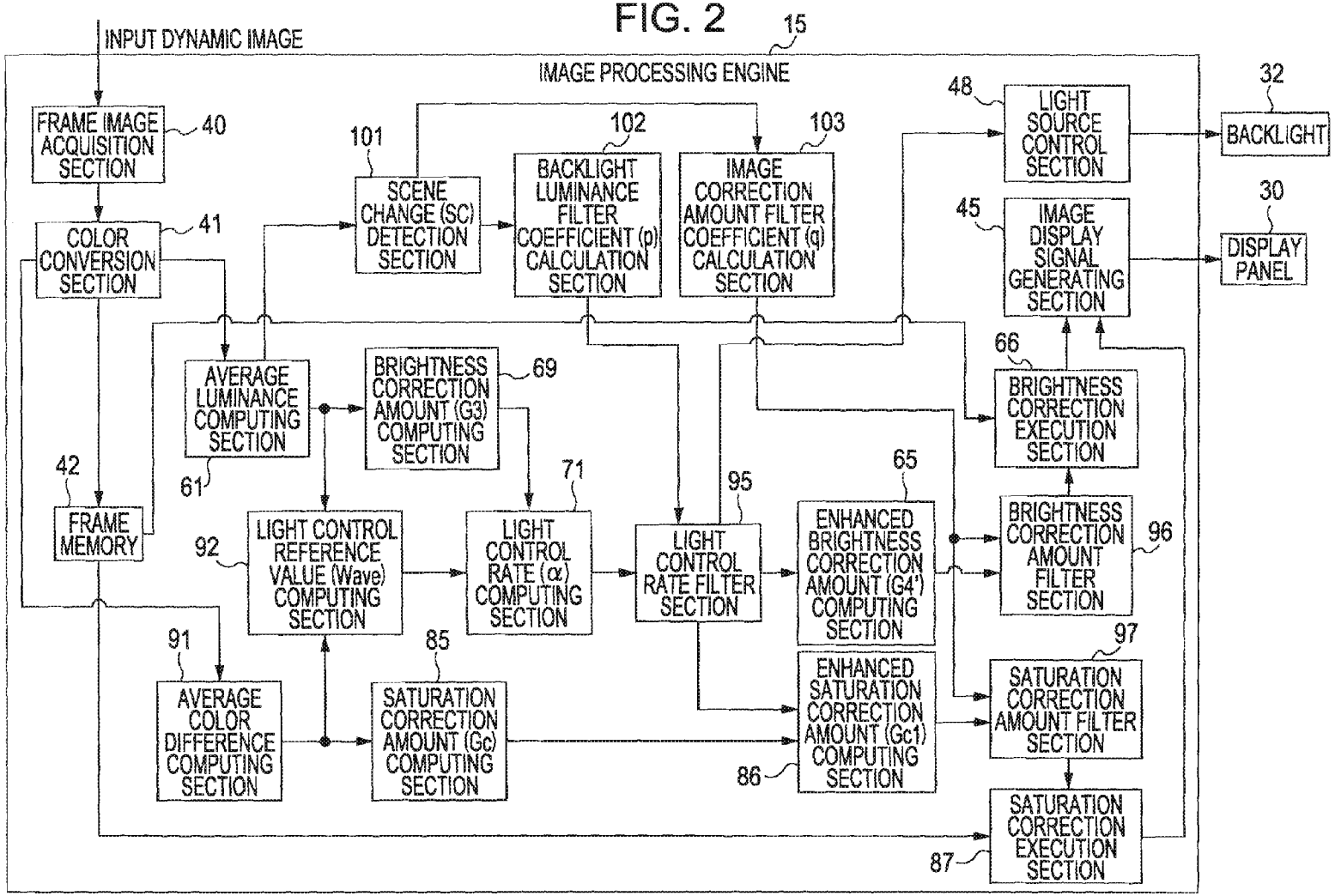
FIG. 2 is a view that shows the configuration of an image processing engine according to the first embodiment of the invention.

FIG. 2 is a view that shows the configuration of the image processing engine according to the first embodiment. As shown in FIG. 2, the image processing engine 15 includes a frame image acquisition section 40, a color conversion section 41, a frame memory 42, an average luminance computing section 61, a brightness correction amount (G3) computing section 69, a light control reference value (Wave) computing section 92, an average color difference computing section 91, a saturation correction amount (Gc) computing section 85, a light control rate ($\alpha$) computing section 71, a light control rate filter section 95, an enhanced brightness correction amount (G4') computing section 65, an enhanced saturation correction amount (Gc1) computing section 86, a brightness correction amount filter section 96, a saturation correction amount filter section 97, a brightness correction execution section 66, a saturation correction execution section 87, an image display signal generating section 45, a light source control section 48, a scene change (SC) detection section 101, a backlight luminance filter coefficient (p) calculation section 102, and an image corrections amount filter coefficient (q) calculation section 103. The thus configured image processing engine 15 is formed of a hardware circuit, such as an ASIC. The following will describe processes executed by the above sections.

The frame image acquisition section 40 sequentially acquires image data of a frame image, which is an image of each frame of a dynamic image, from dynamic image data that are input through the input I/F 10 to the image display device 1.

In addition, the input dynamic image data are data that indicate a plurality of still images (hereinafter, referred to as "frame images") that are successive in time sequence, for example. The dynamic image data may be compressed data or the input dynamic image may be interlaced data. In such a case, the frame image acquisition section 40 executes extraction of the compressed data or executes conversion of the interlaced data to non-interlaced data. Thus, the frame image acquisition section 40 converts image data of each frame image of dynamic image data to image data of a type that can be handled by the image processing engine 15 to acquire the image data. Note that, when still image data are input, the frame image acquisition section 40 is also able to handle a still image by acquiring image data of the still image.

In the present embodiment, for a large number of pixels that are arranged in a matrix, for example, of 640 by 480 pixels, YCbCr data, which are represented mainly using Y (luminance), Cb(U) (color difference specified by blue-yellow axis) and Cr(V) (color difference specified by red-green axis), are acquired as image data. In this case, "$0 \leqq Y \leqq 255$", "$-128 \leqq Cb, Cr \leqq 127$", and "Cb, Cr=0" indicate a gray axis. Note that the number of pixels that display a frame image and the number of gray scale levels of each pixel are not limited to it. In addition, as to the model describing image data as well, it is not limited to YCbCr data. It may be data using various models, such as RGB data that use 256 gray scale values, that is, "0" to "255" (8-bit), for respective colors R (red), G (green), and B (blue).

The color conversion section 41 converts the image data, which are acquired by the frame image acquisition section 40, to luminance data and color difference data. Specifically, the color conversion section 41 changes the acquired image data to YCbCr data. More specifically, the color conversion section 41, when the acquired data are YCbCr data, does not execute color conversion. Only when the acquired image data are RGB data, the color conversion section 41 executes color conversion. Specifically, when the acquired image data are RGB data, the color conversion section 41 calculates, for example, a computing equation to convert the RGB data to YCbCr data. Note that the color conversion section 41 may store a color conversion table that contains the conversion results of the computing equation for each gray scale levels (0 to 255) of RGB and then convert the image data to gray scale values that use 256 gray scales (8-bit) on the basis of the color conversion table.

The image data processed in the color conversion section 41 are stored in the frame memory 42. Specifically, the frame memory 42 keeps image data of one screen. Note that the image processing engine 5 may be configured without the frame memory 42. When the image processing engine 15 includes the frame memory 42, it is possible to execute a process on the frame from which an image characteristic amount is extracted. However, when the image processing engine 15 does not include the frame memory 42, it is also possible to execute a process using an image characteristic amount of the previous frame.

The average luminance computing section 61 acquires image data that are processed in the color conversion section 41 and calculates an average luminance Yave, or the like, of the image data. The average color difference computing section 91 acquires the image data that are processed in the color conversion section 41 and calculates average color differences |cb|ave and |cr|ave of the image data. Other than that, the average color difference computing section 91 calculates an average saturation Save of the image data.

Here, brightness correction according to the present embodiment will be described. The brightness correction is executed so that the brightness is approximated to a predetermined brightness reference. Specifically, the brightness correction is executed in accordance with the following emulation.

$$Y''=F(Y)\times G3+Y \quad \text{Equation (1)}$$

In Equation (1), "Y" is a luminance value that is input, "G3" is an amount of brightness correction (hereinafter, referred to as "brightness correction amount") at a predetermined luminance value, and "F(Y)" is a brightness correction coefficient that indicates a ratio of a correction value to the reference correction amount G3 at each of the luminance values Y. The following will describe a method of determining a correction curve shown in Equation (1), that is, a method of determining a brightness correction coefficient F(Y) and a brightness correction amount G3 one by one.

Figure 3A:
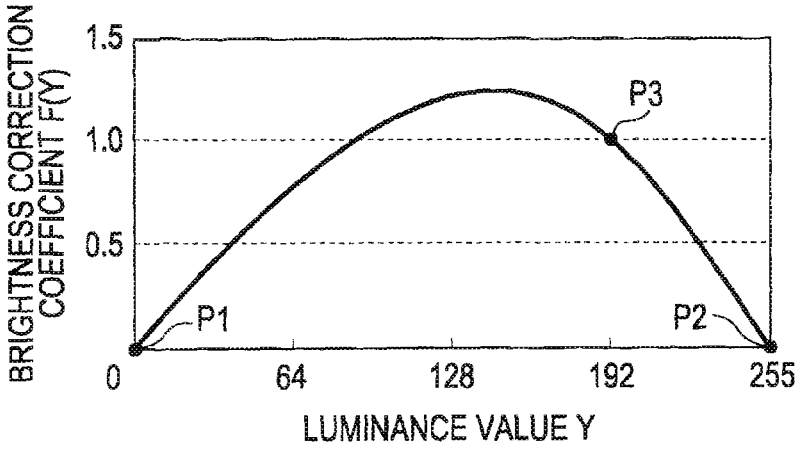
FIG. 3A to FIG. 3C are views that show the relationship between luminance values and brightness correction coefficients.
Figure 3B:
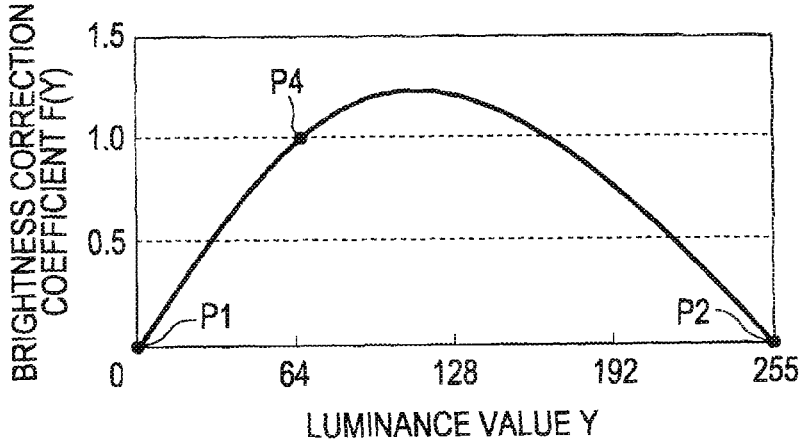
Figure 3C:
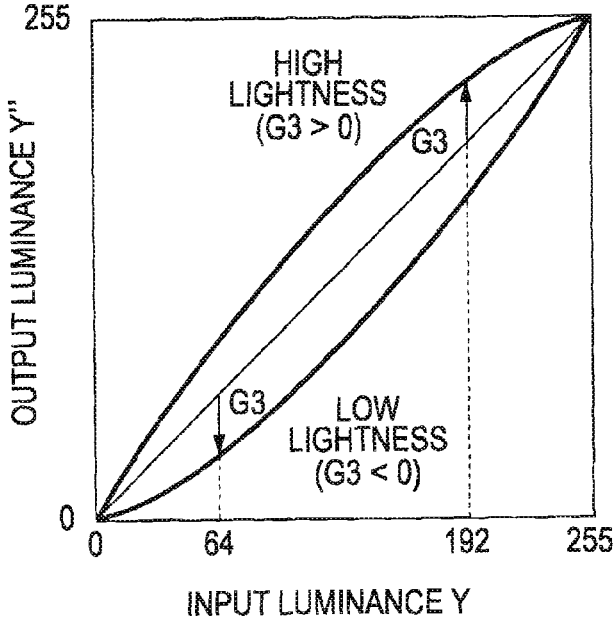

The brightness correction coefficients F(Y) employ a function that is determined in advance. FIG. 3A to FIG. 3C are views that show the relationship between the luminance values Y and the brightness correction coefficients F(Y). The brightness correction coefficients F(Y) employ a curve of which a correction point is defined at "192" as a gray scale value of correction reference, as shown in FIG. 3A, and also employ a curve of which a correction point is defined at "64" as a gray scale value of correction reference, as shown in FIG. 3B. The brightness correction coefficients F(Y), when the correction point is "192" as shown in FIG. 3A, are shown by a curve that passes P1(0,0), at which F(Y) is "0" and the luminance value is "0", and P2(255,0), at which F(Y) is "0" and the luminance value is "255", and P3(192,1), at which F(Y) is "1" and the luminance value is "192", that is, the correction point. In other words, in the present embodiment, the brightness correction coefficients F(Y) are given as a function that is shown by a cubic spline curve.

Thus, the image display device 1 according to the first embodiment includes two types of brightness correction coefficients F(Y) and uses one of the correction coefficients F(Y) depending on positive value or negative value of the brightness correction amount G3. Specifically, when the brightness correction amount G3 is positive, the brightness correction coefficients F(Y) that employ "192" as the correction point are used. On the other hand, when the brightness correction amount G3 is negative, the brightness correction coefficients F(Y) that employ "64" as the correction point are used. Thus, as shown in FIG. 3C, the luminance values Y (in put luminances) are converted depending on positive value or negative value of the brightness correction amount G3. That is, the above Equation (1) indicates a correction curve that is convex upward or downward in accordance with the sign of the brightness correction amount G3.

Specifically, the brightness correction amount G3 shown in Equation (1) is obtained through calculation of the following equation in the brightness correction amount computing section 69.

$$G3=Ga(Yth-Yave) \quad \text{Equation (2)}$$

In Equation (2), "Ga" is a brightness correction intensity coefficient that is a predetermined value equal to 0 or above, and "Yth" is a brightness reference (that is, a reference gray scale value). As is apparent from Equation (2), the brightness correction amount G3 is proportional to a value obtained by subtracting the average value Yave of the luminances from the brightness reference Yth, so that, when the luminance values Y are corrected in accordance with the brightness correction amount G3, the luminance values Y are corrected so as to be approximated to the brightness reference Yth. Thus, it is possible to reduce biased luminance values of image data. The thus obtained brightness correction amount G3 is used when the light control rate computing section 71 calculates a light control rate α. Note that the value of the brightness correction intensity coefficient Ga and the brightness reference Yth may be determined as constants in advance or may be set by a user. Alternatively, the value of the brightness correction intensity coefficient Ga and the bright reference Yth may be determined in coordination with types of image data.

The following will describe saturation correction according to the present embodiment. The saturation correction is executed so that the saturations are approximated to a predetermined saturation reference. Specifically, in accordance with the following equation, the color differences cb, cr are converted to color differences Cb, Cr. And, the word "saturation correction" is the same meaning as the word "chroma correction". Within this document, it explains using the word "saturation correction".

$$Cb=Fc(cb)\times Gc+cb \quad \text{Equation (3)}$$

$$Cr=Fc(cr)\times Gc+cr \quad \text{Equation (4)}$$

Here, "cb, cr" are color differences after color conversion by the color conversion section 40, "Gc" is a correction amount at a predetermined saturation (hereinafter, referred to as "saturation correction amount"), and "Fc(C)" is a correction coefficient (hereinafter, referred to as "saturation correction coefficient") that indicates a ratio of a correction value to the reference correction amount Gc at each color difference value. The following will describe a method of determining a correction curve shown in Equation (3) and Equation (4), that is, a method of determining saturation correction coefficients Fc(C) and a saturation correction amount Gc one by one.

Figure 4A:
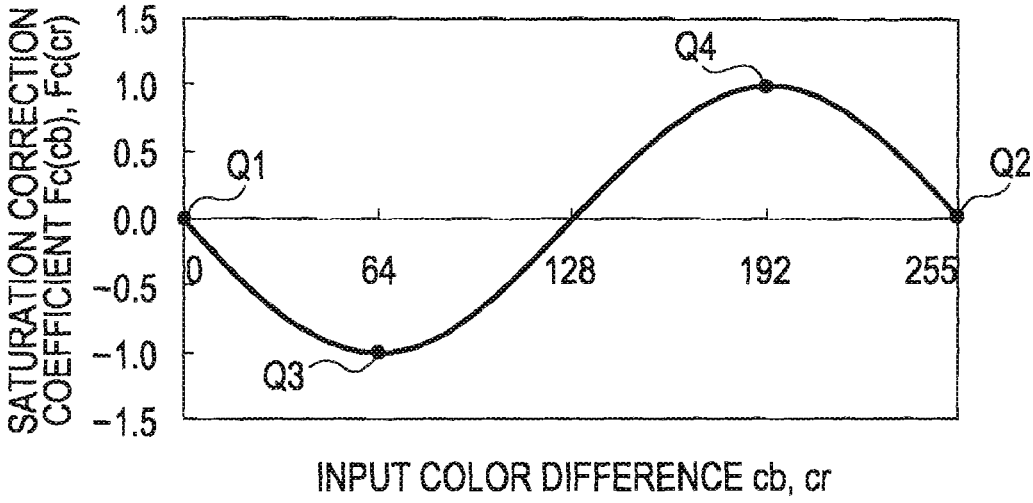
FIG. 4A and FIG. 4B are views that are used for explaining a saturation correction coefficient.
Figure 4B:
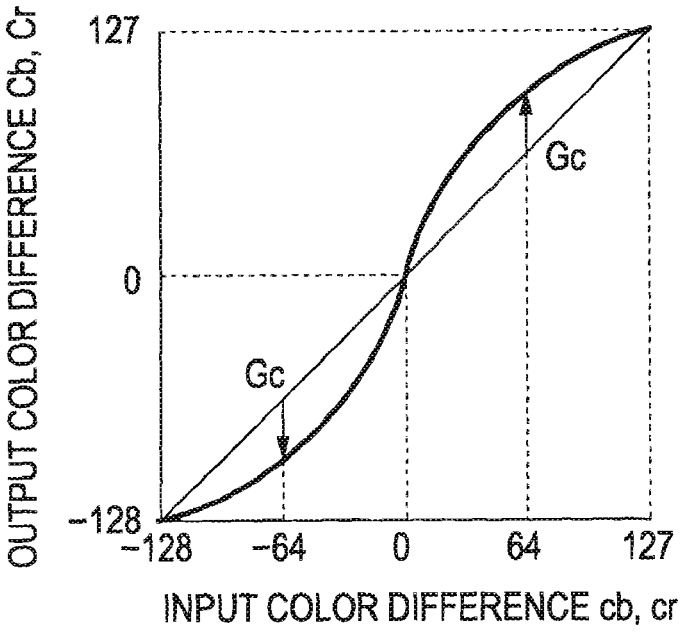

The saturation correction coefficients Fc(C) em;ploy a function that is determined in advance. The saturation correction coefficients Fc(C) will be described with reference to FIG. 4A and FIG. 4B. FIG. 4A shows the relationship between the color difference values cb, cr and the saturation correction coefficients Fc(C). FIG. 4B shows the relationship between the input color differences cb, or and the output color differences Cb, Cr when saturation correction is executed on the basis of the saturation correction coefficients Fc(C)

The saturation correction coefficients Fc(C) as shown in FIG. 4A, are given by a curve that has correction points of "64" and "192", which are color difference values used as correction references. The saturation correction coefficients Fc(C) are expressed by a curve that passes Q1(0,0), at which Fc(C) is "0" and the color difference value is "0", and Q2(255, 0), at which Fc(C) is "0" and the color difference value is "255", Q3(64,−1), at which Fc(C) is "−1" and the color difference value is "64", that is, the correction point, and Q4(192,1), at which Fc (C) is "1" and the color difference value is "192", that is, the correction point. In the first embodiment, the saturation correction coefficients Fc(C) are given by a function that is shown by a cubic spline curve and are coefficients that are obtained by offsetting the function at "+128". By executing correction using the above saturation correction coefficients Fc(C), the color differences cb, cr (input color differences) are converted as shown in FIG. 4B. Note that the data of the saturation correction coefficients Fc((C) shown in FIG. 4A are stored as a table that contains values of Fc(C) corresponding to values that the color difference values cb, cr can take.

The above described saturation correction amount Gc is obtained through calculation of the following equation by the saturation correction amount computing section 85.

$$Gc=Gs(sth-Save) \quad \text{Equation (5)}$$

Here, "Gs" is a saturation correction intensity coefficient that has a predetermined value of 0 or above, "sth" is a saturation reference (reference saturation value), and "save" is an average. In this case, the saturations s are expressed as "s=(|cb|+|cr|)/2". Note that the value of the saturation correction intensity coefficient Gs and the saturation reference sth may be determined as constants in advance or may be set by a user. Alternatively, the value of the brightness correction intensity coefficient Ga and the brightness reference Yth may be determined in coordination with types of image data.

As is apparent from Equation (5), the saturation correction amount Gc is proportional to a value obtained by subtracting the average saturation save from the saturation reference sth, so that, when the saturation values S are corrected in accordance with the saturation correction amount Gc, the saturation values S are corrected so as to be approximated to the saturation reference sth. Thus, it is possible to reduce biased saturation values of image data. The thus obtained saturation correction amount Gc is used when the enhanced saturation correction amount computing section 86 calculates an enhanced saturation correction amount Gc1.

Subsequently, the light control reference value computing section 92 acquires the average luminance Yave from the average luminance computing section 61 and also acquires the average color differences |cb|ave, |cr|ave from the average color difference computing section 91 and, using these average luminance and average color differences, calculates a light control reference value Wave. Specifically, the light control reference value computing section 92 determines the light control reference value Wave on the basis of the following equation.

$$Wave=\max(Yave, 2|cb|ave, 2|cr|ave) \quad \text{Equation (6)}$$

As is apparent from Equation (6), the light control reference value computing section 92 determines the average luminance Yave, twice the average value of the color differences cb (2|cb|ave), or twice the average value of the color differences (2|cr|ave), whichever is the maximum value, as the light control reference value Wave. Note that the light control reference value Wave is used as a reference input gray scale value when a light control rate α, which will be described later, is calculated, in order to appropriately determine a high saturation image and then execute light control in response to the high saturation image, that is, in order to suppress a decrease in saturations in a high saturation image due to light control. In addition, the computing equation of the light control reference value that is used for obtaining a light control rate α is not limited to the above described Equation (6).

The light control rate computing section 71 acquires the brightness correction amount G3 from the brightness correction amount computing section 69 and also acquires the light control reference value Wave from the light control reference value computing section 92 and, using these brightness correction amount G3 and the light control reference value Wave, calculates a light control rate α. In the present embodiment, the light control rate α is obtained on the basis of the following way of thinking described below.

In the present embodiment, the brightness correction is executed to reduce variation in luminances, which occurs in an image displayed due to light control while correcting biased luminance values (hereinafter, this correction is termed as "enhanced brightness correction"). The correction equation of the enhanced brightness correction is defined by the following equation.

$$\Sigma(Y)=F(Y)\times G4+Y \quad \text{Equation (7)}$$

Here, a correction amount G4 is determined so that the product of the average value of luminance values Z, for which enhanced brightness correction is executed, and the light control rate α is equal to the average value of luminance values Y" (hereinafter, "correction amount G4" is termed as "enhanced brightness correction amount G4"). That is, the enhanced brightness correction amount G4 is determined so as to satisfy the following Equation (8).

$$\alpha\times Zave=Y''ave \quad \text{Equation (8)}$$

Equation (8) indicates that the luminances that display an image based on the luminance values Y" are visually made equal to the luminances that display an image based on the luminance values Z after light control. Here, the right-hand side and left-hand side of Equation (8) may be expressed as the following equation.

$$\begin{aligned} Y''ave &= \Sigma Y''/N \\ &= (\Sigma F(Y)\times G3+\Sigma Y)/N \end{aligned} \quad \text{Equation (9)}$$

$$\begin{aligned} Z'ave &= \Sigma Z'/N \\ &= (\Sigma F(Y)\times G4+\Sigma Y)/N \end{aligned} \quad \text{Equation (10)}$$

Through Equation (8) to Equation (10), the following equation that expresses the enhanced brightness correction amount G4 may be obtained.

$$G4=G3/\alpha+(1-\alpha)\Sigma Y/(\alpha\Sigma F(Y)) \quad \text{Equation (11)}$$

Here, the enhanced brightness correction amount G4 that appears in Equation (11) is not as a function of the luminance values Y" but as a function or the brightness correction amount G3, so that the brightness correction section 44 is able to calculate the enhanced brightness correction amount G4 on the basis of the brightness correction amount G3 without calculation using Equation (5) actually. Using the thus calculated enhanced brightness correction amount G4, it is possible to execute enhanced brightness correction that reduces variation in luminances due to light control after biased luminance values are corrected.

Figure 5:
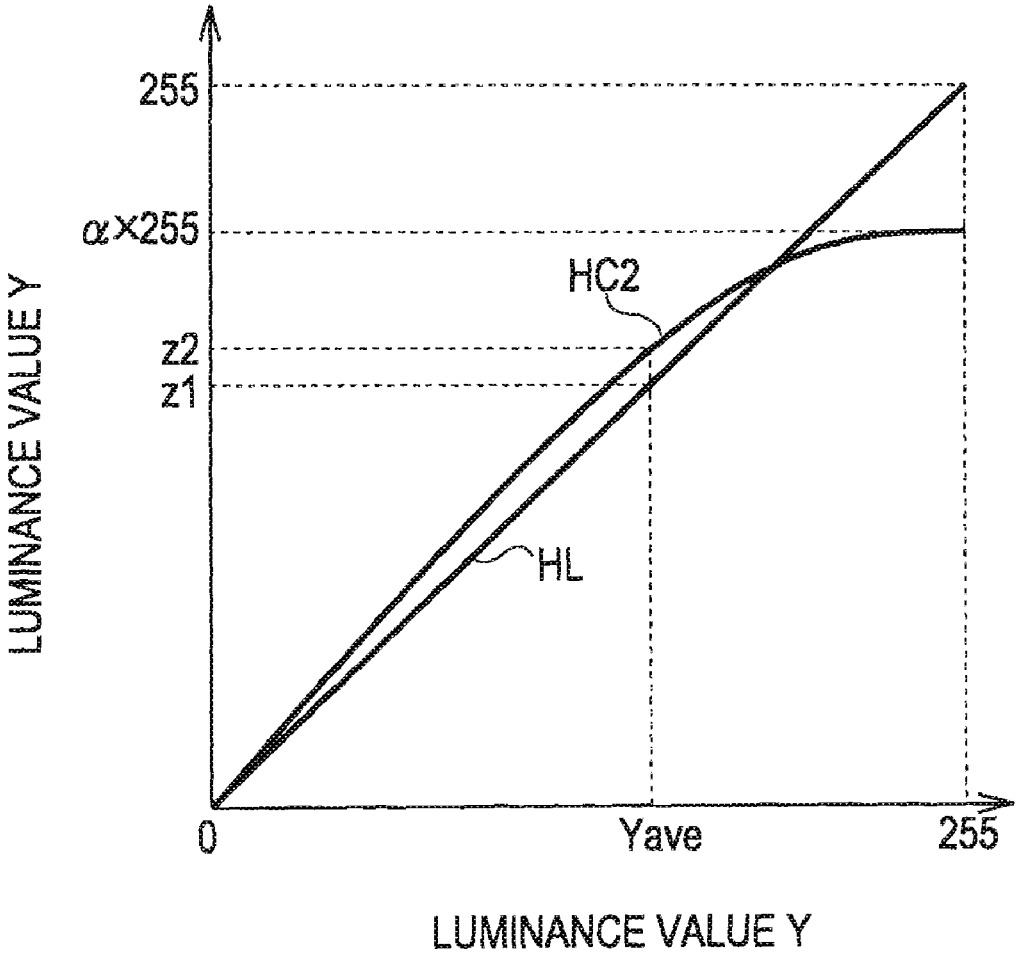
FIG. 5 is a view that shows a correction curve for brightness correction when an for brightness correction takes a positive value.

Here, as described above, when the brightness correction is executed, there is a possibility that a contrast corresponding to a high luminance region is reduced. FIG. 5 is a view that shows a correction curve HC2 of brightness correction when "G3=0" in Equation (1), that is, when dimming is performed without brightness correction, and the average luminance is then made equal to the resulting value. In other words, FIG. 5 shows the correction curve HC2 of brightness correction when the enhanced brightness correction amount G4 takes a positive value. In addition, in FIG. 5, the gray scale line of the luminance values Y, when level correction is performed, is shown by a correction line HL. As shown in FIG. 5, the gray scale levels of the correction line HL, when no brightness correction is performed, corresponding to luminances higher than the average luminance Yave, range from z1(=Yave) to 255. When the brightness correction is executed by the upward convex gray scale curve HC2 using the brightness correction amount G3 (>0), the range of luminance values obtained by multiplying luminance values Z corresponding to the range of Yave to 255 of the luminance values Y higher than the average value Yave of the luminances Y by the light control rate α is from z2(=α×Z(Yave)) to 255×α according to the correction curve HC2. Thus, the range of luminances from z2 to 255×α, which correspond to the luminances Y equal to Yave or above, is made narrower than the original range of luminances from z1 to 255. That is, because the range of luminance values that allow to present high and low of luminance values is made narrow, the contrast is decreased. Then, in the present embodiment, in order to suppress a decrease in contrast on the high luminance side due to light control within a certain level, the value of the light control rate α is restricted.

On the higher gray scale side than the luminance value corresponding to the average luminance value Yave of the luminance values Y, including when the brightness correction amount G3 is not 0, a gray scale difference L1 of the luminance values Y" without light control and a gray scale difference L2 of effective luminance values α×Z' with light control may be expressed as the following equations.

$$L1=255-Y''(Yave)=255-(F(Yave)\times G3+Yave) \quad \text{Equation (12)}$$

$$L2=\alpha\times 255-\alpha\times Z'(Yave)=\alpha\times(255-(F(Yave)G4+Yave)) \quad \text{Equation (13)}$$

Then, from Equation (12) and Equation (13), an equation that expresses a contrast retention rate R is obtained as the following equation.

$$R=L2/L1=\alpha\times(255-(F(Yave)G4+Yave))/(255-(F(Yave)\times G3+Yave)) \quad \text{Equation (14)}$$

An equation when the contrast retention rate R is limited to Rlim is expressed as the following equation. Note that, as described above, in order to execute light control by appropriately detecting a high saturation color (that is, in order to suppress a decrease in saturations due to light control), in Equation (14), the reference input gray scale value is changed from "Yave" to "Wave" to define the Rlim. That is, the Rlim is defined using the light control reference value Wave that is calculated in the light control reference value computing section 92.

$$R\text{lim}=\alpha\text{lim}\times(255-(F(Wave)G\text{lim}+Wave))/(255-(F(Wave)\times G3+Wave)) \quad \text{Equation (15)}$$

"αlim" in Equation (15) indicates a limit light control rate, and "G4lim" indicates a limit correction amount. Here, the limit light control rate αlim may be expressed as the following equation.

$$\alpha\text{lim}=(\Sigma F(Y)\times G3+\Sigma Y)/(\Sigma F(Y)\times G\text{lim}+\Sigma Y) \quad \text{Equation (16)}$$

In addition, under the condition of Equation (8), using Equation (9), Equation (10) and Equation (15), the limit correction amount G4lim may be determined as the following Equation (17). Note that the limit correction amount Glim itself is used as the enhanced brightness correction amount G4.

$$G\text{lim}=\frac{\{Rlim\times F(\text{Wave})\times\Sigma Y+(255-\text{Wave})\times\Sigma F(Y)\}\times G3+(1-Rlim)\times(255-\text{Wave})\times\Sigma Y}{(1-Rlim)\times F(\text{Wave})\times\Sigma F(Y)\times G3+F(\text{Wave})\times\Sigma Y+Rlim\times(255-\text{Wave})\times\Sigma F(Y)} \quad \text{Equation (17)}$$

The light control rate computing section 71 calculates the limit light control rate αlim by substituting Equation (16) using the thus obtained limit correction amount G4lim. Furthermore, the light control rate computing section 71 calculates a light source fight control rate K (hereinafter, referred to as "backlight luminance") by substituting the following equation using the limit light control rate αlim. Note that "γ" indicates a gamma coefficient.

$$K=\alpha^{\gamma} \quad \text{Equation (18)}$$

Note that the relationship of the limit light control rate α, the backlight luminance K, or the limit correction amount Glim relative to the light control reference value Wave may be made as a table in advance, and the limit light control rate αlim and the backlight luminance K may be obtained using the table without executing the above calculation.

Subsequently, the scene change detection section 101 detects a scene change SC (change of scene) in an input dynamic image. The scene change SC is a change in average luminance between the adjacent frames of an input dynamic image and is calculated by the following equation.

$$SC=|\Delta Yave| \quad \text{Equation (19)}$$
$$=|Yave[nT]-Yave[(n-1)T]|$$

The backlight luminance filter coefficient calculation section 102 acquires the scene change SC and calculates a backlight luminance filter coefficient u that is used when the light control rate filter section 95 executes filtering. The image correction amount filter coefficient calculation section 103 acquires the scene change SC and calculates an image correction amount filter coefficient q that is used when the brightness correction amount filter section 96 and the saturation correction amount filter section 97 execute filtering. Note that a method of obtaining the filter coefficients will be specifically described later.

The light control rate filter section 95 executes filtering, between the adjacent frames, on the light control rate αlim obtained for each frame using the backlight luminance filter coefficient p that is acquired from the backlight luminance filter coefficient calculation section 102. That is, the light control rate filter section 95 executes filtering on a light source luminance (the amount of source light) for each frame, namely, a backlight luminance K for each frame, on the basis of the backlight luminance filter coefficient p. Note that the light control rate after filtering is termed as "light control rate αflt", and the backlight luminance after filtering is termed as "backlight luminance Kflt". In addition, the process executed by the light control rate filter section 95 will be specifically described later.

The enhanced brightness correction amount computing section 65 acquires the light control rate αflt, for which filtering is executed in the light control rate filter section 95, and calculates the enhanced brightness correction amount G4' on the basis of the light control rate αflt. Specifically, the enhanced brightness correction amount computing section 65 obtains the enhanced brightness correction amount G4' by substituting the following equation that is transformed from the above described Equation (16) using the filtered light control rate αflt.

$$G4'=G3/\alpha flt+\{(1-\alpha flt)\times\Sigma Y\}/\{\alpha flt\times\Sigma F(Y)\} \quad \text{Equation (20)}$$

The enhanced saturation correction amount computing section 86 acquires the saturation correction amount Gc that is calculated in the saturation correction amount computing section 85 and also acquires the light control rate αflt that is filtered in the light control rate filter section 95, and then calculates the enhanced saturation correction amount Gc1 on the basis of these saturation correction amount Gc and the light control rate αflt. In the present embodiment, the enhanced saturation correction amount Gc1 is obtained on the basis of the following way of thinking described below.

In the present embodiment, the correction is executed to reduce variation in saturations, which occurs in an image displayed due to light control while correcting biased saturation values (hereinafter, termed as "enhanced saturation correction"). The correction equation of the enhanced saturation correction is defined by the following equation.

$$Cb'(cb)=Fc(cb)\times Gc1+cb \quad \text{Equation (21)}$$

$$Cr'(cr)=Fc(cr)\times Gc1+cr \quad \text{Equation (22)}$$

In Equation (21) and Equation (22), "Gc1" indicates the enhanced saturation correction amount. In this embodiment, the enhanced saturation correction amount Gc1 is determined so that the product of the average value of saturation values S' determined from color differences Cb', Cr', for which enhanced saturation correction is executed, and the light control rate α is equal to the average value of saturation values S determined from the color differences Cb, Cr, for which normal saturation correction is executed. That is, the enhanced saturation correction amount Gc1 is calculated so as to satisfy the following equation. Note that the light control rate employs the filtered light control rate αflt.

$$\alpha flt \times S'ave = Save \qquad \text{Equation (23)}$$

Equation (23) indicates that the saturations that display an image based on the color differences Cb, Cr are visually made equal to the saturations that display an image based on the color differences Cb', Cr' after light control. Here, the right-hand side and left-hand side of Equation (23) may be expressed as the following equation.

$$\begin{aligned} Save &= \Sigma S / N \qquad \text{Equation (24)} \\ &= (\Sigma|Fc(cb)| \times Gc + \Sigma|cb| + \\ &\quad \Sigma|Fc(cr)| \times Gc + \Sigma|cr|) / N \end{aligned}$$

$$\begin{aligned} S'ave &= \Sigma S' / N \qquad \text{Equation (25)} \\ &= (\Sigma|Fc(cb)| \times Gc1 + \Sigma|cb| + \\ &\quad \Sigma|Fc(cr)| \times Gc1 + \Sigma|cr|) / N \end{aligned}$$

Through Equation (23) to Equation (25), the enhanced saturation correction amount Gc1 may be expressed as the following equation. The enhanced saturation correction amount computing section 86 calculates the enhanced saturation correction amount Gc1 using Equation (26).

$$Gc1 = Gc/\alpha flt + \{(1-\alpha flt) \times (\Sigma|cb| + \Sigma|cr|)\} / \{\alpha flt \times (\Sigma|Fc(Cb)| + \Sigma|Fc(cr)|)\} \qquad \text{Equation (26)}$$

The brightness correction amount filter section 96 executes filtering, between the adjacent frames, on the enhanced brightness correction amount G4' obtained for each frame using the image correction amount filter coefficient q that is acquired from the image correction amount filter coefficient calculation section 103. Thus, the enhanced brightness correction amount G4flt after filtering is obtained. In addition, the saturation correction amount filter section 97 executes filtering, between the adjacent frames, on the enhanced saturation correction amount Gc1 obtained for each frame using the image correction amount filter coefficient q that is acquired from the image correction amount filter coefficient calculation section 103. Thus, the enhanced saturation correction amount Gc1flt after filtering is obtained. Note that, hereinafter, the brightness correction amount filter section 96 and the saturation correction amount filter section 97 are collectively termed as "image correction amount filter section", the enhanced brightness correction amount G4' and the enhanced saturation correction amount Gc1 are collectively termed as "image correction amount Gy", and the image correction amount after filtering is termed as "image correction amount Gyflt". In addition, the process executed by the brightness correction amount filter section 96 and the saturation correction amount filter section 97 will be specifically described later.

The brightness correction execution section 66 executes brightness correction on image data using the filtered enhanced brightness correction amount G4flt. In addition, the saturation correction execution section 87 executes saturation correction on the image data using the filtered enhanced saturation correction amount Gc1flt.

The light source control section 48 executes light control of the amount of light generated by the backlight 3 so that the light source control section 48 controls power supplied from the power supply unit 31 to the backlight 32 in accordance with the light control rate αflt (corresponding to the backlight luminance Kflt) that is obtained by filtering in the light control rate filter section 95. The image display signal generating section 45 generates an image display signal corresponding to the image data for which the above described brightness correction and saturation correction are executed. In addition, the image display signal generating section 45 sends a generated image display signal to the display panel 30 while synchronizing with the timing when the light source control section 48 controls a light source. Then, the display panel 30, on the basis of the received image display signal, controls the amount of transmission for each pixel by modulating light emitted from the backlight 32, thus displaying an image.

Configuration of Light Control Rate Filter Section and Image Correction Amount Filter Section The following will describe the process executed in the light control rate filter section 95 and the image correction amount filter section (the brightness correction amount filter section 96 and the saturation correction amount filter section 97) and the configuration thereof.

When only the above described brightness correction and saturation correction are executed, the average luminance and the average saturation are retained even when the backlight 32 is dimmed; however, there is a possibility that a flicker occurs when a dynamic image is reproduced. As a countermeasure to such a flicker, filtering may be conceived. Here, it is conceivable that the filtering is executed using a fixed filter; however, this method may be inappropriate to a quick scene change or a slow scene change (the same scene) of dynamic image. That is, to the quick scene change, it may be noticed that the backlight luminance and/or the image correction gradually change due to a delayed follow-up, while, on the other hand, to the slow scene change (the same scene), a flicker may occur due to a frequent change in backlight luminance and/or image correction. On the other hand, it is conceivable that the same time constant is used for filtering of light control and filtering of image correction; however, this method may be visually inappropriate. Specifically, light control changes white light. This results in changing adaptational white light of which a human being is gazing at a video image and, hence, it is easy to notice a flicker. In contrast, the image correction is a process to change a halftone (after white color is determined) and, hence, it 1s more difficult to notice a flicker than light control. The countermeasures to the above described inconveniences may be a method to execute filtering using a different time constant. However, this method may break a balance between light control and image correction.

In consideration of the above situation, in the present embodiment, filtering is executed in the following manner. In the present embodiment, filtering is executed on the backlight luminance K and the image correction amount Gy using different time constants (filter coefficients). Specifically, a filter having a long time constant (corresponding to the backlight luminance filter coefficient p) is used for the backlight luminance K, and a filter having a short time constant (corresponding to the image correction amount filter coefficient q) is used for the image correction amount Gy to execute filtering. This is because, when a change in the backlight luminance is compared with a change in the image correction amount, a change in the backlight luminance is visually easily recognized due to a change in white point (and black), while a change in the image correction amount is hardly recognized due to a change in halftone. That is, in order to prevent a flicker due to a change in white point for the backlight luminance and to ensure a quick response to a scene change in a dynamic image while preventing a flicker for the image correction amount, filtering is executed using the above described different time constants.

Furthermore, in the present embodiment, after filtering (with a long Lime constant) is executed on the backlight luminance K that is obtained for each frame, the image correction amount Gy is calculated using the result, and then filtering (with a short time constant) is executed on the obtained image correction amount Gy. The above manner is performed to suppress breaking of a balance between the light control and the image correction. For example, it suppresses the relationship between the above described limit light control rate αlim and limit correction amount Glim from being deviated from Equation (16).

Figure 6:
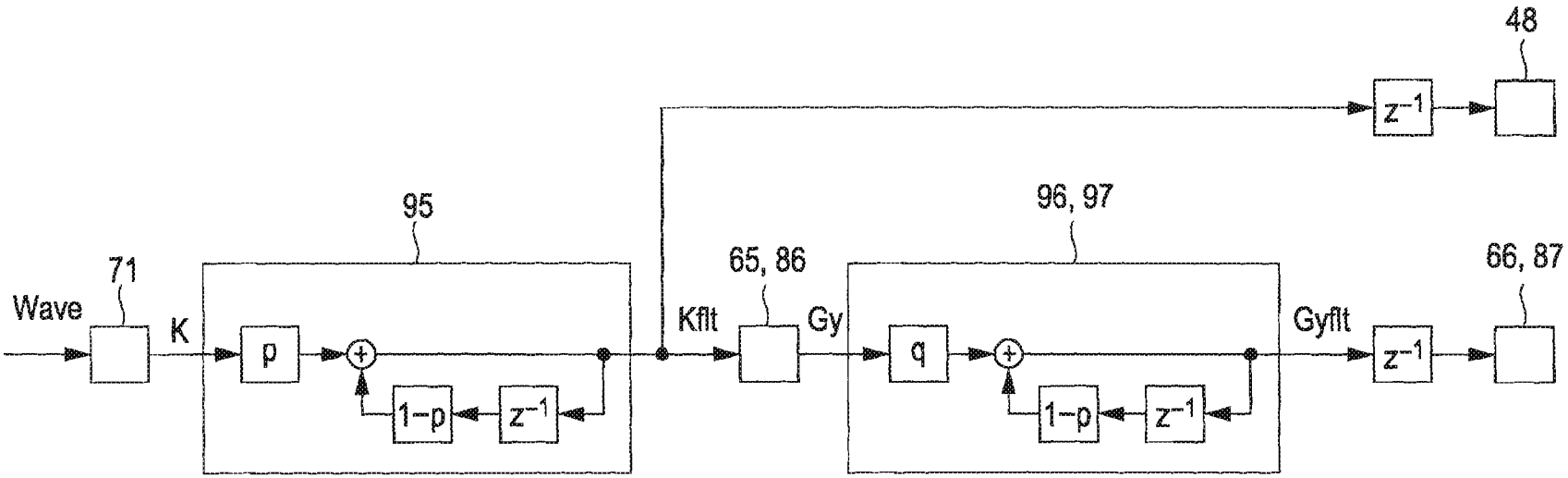
FIG. 6 is a view that shows a process in a light control rate filter section and an image correction amount filter section.

FIG. 6 is a view that shows a process executed in the light control rate filter section 95 and the image correction amount filter section (the brightness correction amount filter section 96 and the saturation correction amount filter section 97). As shown in FIG. 6, the light control rate filter section 95 and the image correction amount filter section execute serial processing. Specifically, after filtering is executed on the backlight luminance K in the light control rate filter section 95, filtering is executed on the image correction amount Gy in the image correction amount filter section.

Specifically, the light control rate filter section 95 acquires the backlight luminance filter coefficient p from the backlight luminance filter coefficient calculation section 102 and executes filtering, between the adjacent frames, on the backlight luminance K (corresponding to the light control rate α) that is obtained for each frame Specifically, a transfer function of filtering in the light control rate filter section 95 is expressed as Equation (27).

$$Hbl[z]=pz/\{z-(1-p)\} \quad \text{Equation (27)}$$

Through the above filtering, the backlight luminance Kflt is obtained. Then, the light control is executed in the light source control section 48 on the basis of the obtained backlight luminance Kflt (corresponding to the light control rate αflt). In addition, on the basis of the obtained backlight luminance Kflt, the enhanced brightness correction amount G4' is calculated in the enhanced brightness correction amount computing section 65, and the enhanced saturation correction amount Gc1 is calculated in the enhanced saturation correction amount computing section 86. That is, the image correction amount Gy is calculated.

Subsequently, the image correction amount filter section executes filtering on the image correction amount Gy that is obtained for each frame using the image correction amount filter coefficient q that is acquired from the image correction amount filter coefficient calculation section 103. Specifically, a transfer function of filtering in the image correction amount filter section is expressed as Equation (28). Note that a transfer function that combines filtering in the light control rate filter section 95 with filtering in the image correction amount filter section is expressed as Equation (29).

$$Himg[z]=qz/\{z-(1-q)\} \quad \text{Equation (28)}$$

$$H[z]=Hbl[z]Himg[z]=pz/\{z-(1-p)\}\times qz/\{z-(1-q)\} \quad \text{Equation (29)}$$

Through the above filtering process, the image correction amount Gyflt is obtained. Specifically, the brightness correction amount filter section 96 executes filtering, between the adjacent frames, on the enhanced brightness correction amount G4' that is obtained for each frame, and the saturation correction amount filter section 97 executes filtering, between the adjacent frames, on the enhanced saturation correction amount Gc1 that is obtained for each frame. Thus, the enhanced brightness correction amount G4flt and the enhanced saturation correction amount Gc1flt, which are filtered, are obtained. Then, the brightness correction is executed in the brightness correction execution section 66 on the basis of the filtered enhanced brightness correction amount G4flt, while the saturation correction is executed in the saturation correction execution section 87 on the basis of the filtered enhanced saturation correction amount Gc1flt.

Figure 7A:
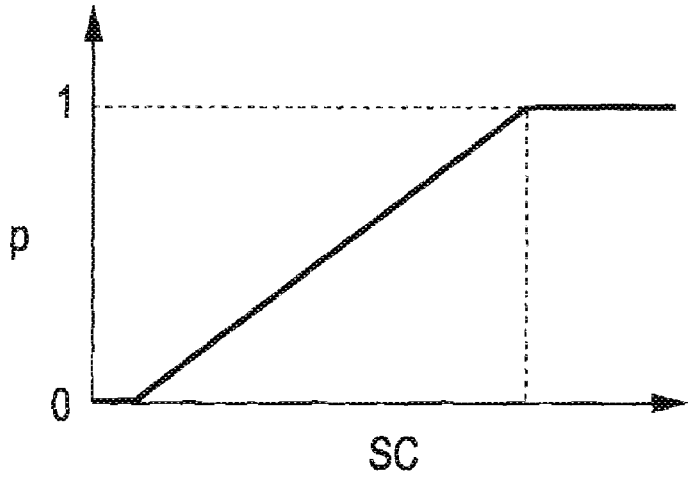
FIG. 7A and FIG. 7B are views for explaining how to obtain a backlight luminance filter coefficient and an image correction amount filter coefficient.
Figure 7B:
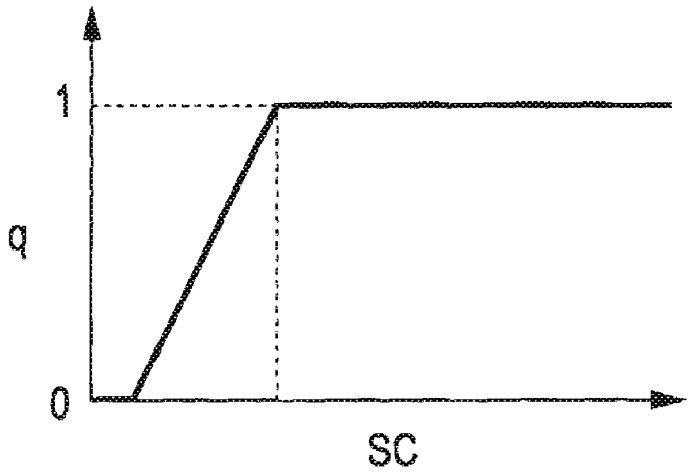

Here, the manner to obtain the backlight luminance filter coefficient p and the image correction amount filter coefficient q will be described with reference to FIG. 7A and FIG. 7B. In FIG. 7A, the abscissa axis indicates a scene change SC, and the ordinate axis indicates a backlight luminance filter coefficient p. In FIG. 7B, the abscissa axis indicates a scene change SC, and the ordinate axis indicates an image correction amount filter coefficient q. Note that FIG. 7A and FIG. 7B show that, the cut-off frequency becomes a lower low-pass filter (that is, the time constant is longer) the closer "p, q" are to "0".

The backlight luminance filter coefficient p and the image correction amount filter coefficient q are respectively calculated by the backlight luminance filter coefficient calculation section 102 and the image correction amount filter coefficient calculation section 103 on the basis of the scene change SC. Specifically, the backlight luminance filter coefficient calculation section 102 determines the backlight luminance filter coefficient p corresponding to the scene change SC using a table or a computing equation that indicates the relationship shown in FIG. 7A. In addition, the image correction amount filter coefficient calculation section 103 determines the image correction amount filter coefficient q corresponding to the scene change SC using a table or a computing equation that indicates the relationship shown in FIG. 7B.

As is apparent from FIG. 7A and FIG. 7B, for the same scene change SC, a larger value is determined to the image correction amount filter coefficient q than to the backlight luminance filter coefficient p (however, when the scene chance SC has a large value, it will be "p=q=1"). Thus, filtering is executed using a filter having a long time constant in the light control rate filter section 95, while filtering is executed using a filter having a short time constant in the image correction amount filter section.

As described above, according to the first embodiment, because time characteristics (filter coefficients) used for the backlight luminance K and the image correction amount Gy are changed in response to the scene change SC of a video image, when backlight dimming for power saving and image correction for compensating for the backlight dimming are performed, or the like, it is possible to suppress the occurrence of a flicker and/or a delayed response and, hence, it is possible to display an image with high quality. In addition, because the filter response of the backlight luminance K is made slow and the filter response of the image correction amount Gy is made quick, it is possible to effectively improve a flicker and a response. Furthermore, because the image correction amount Gy is calculated using the filtered backlight luminance Kflt, it is possible to appropriately suppress breaking of a balance between light control and image correction. Thus, it is possible to display an image with high quality.

Procedure

Figure 8:
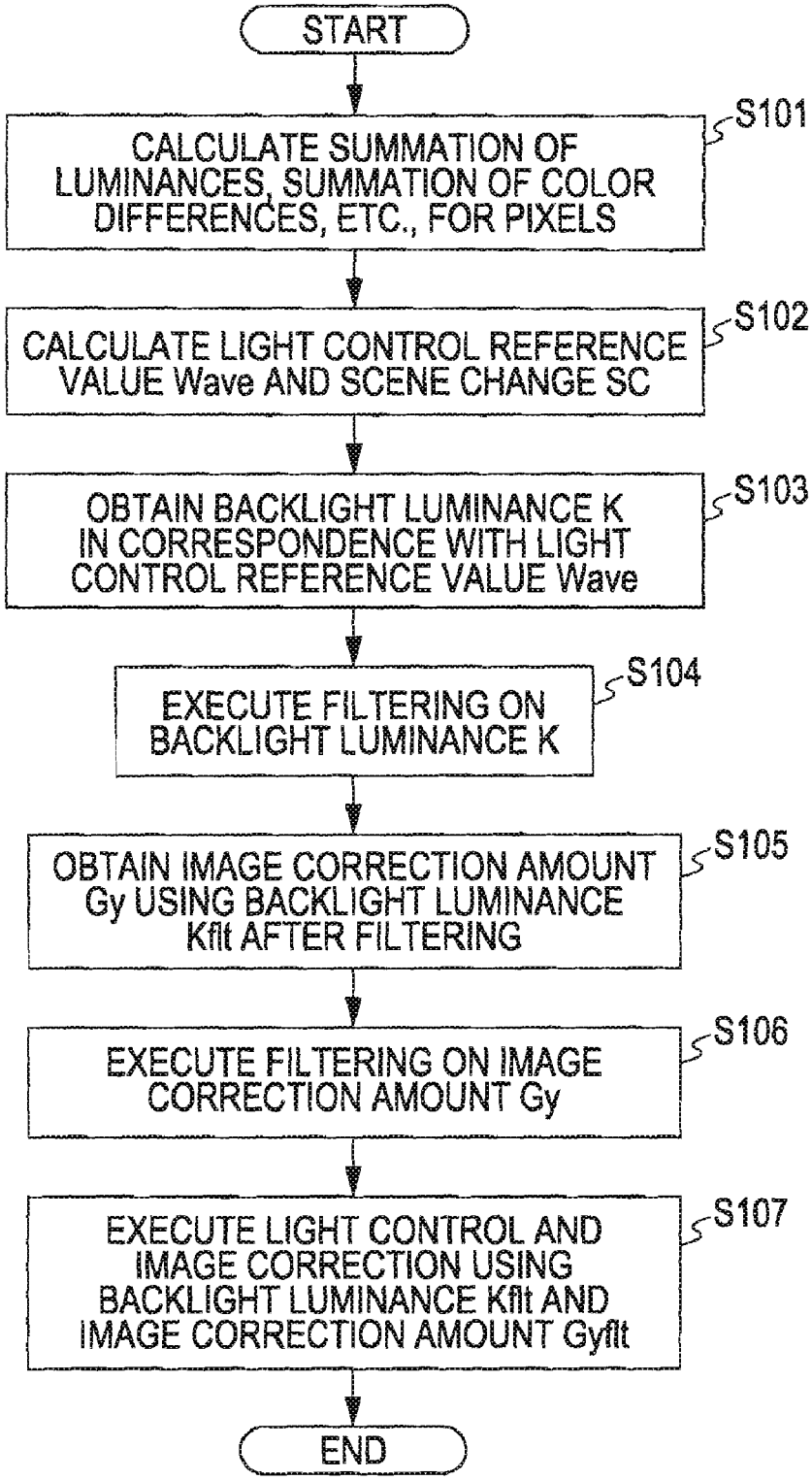
FIG. 8 is a flowchart that shows a process according to the first embodiment of the invention.

The following will describe a procedure of processes executed by the image processing engine 15 with reference to the flowchart shown in FIG. 8.

At first, in step S101, the average luminance computing section 61 and the average color difference computing section 91 calculate the summation of luminances and the summation of color differences for pixels. This process is executed when each frame image is being input. Then, the process proceeds to step S102.

In step S102, the light control reference value computing section 92 calculates the light control reference value Wave, while the scene change detection section 101 calculates the scene change SC. Specifically, the light control reference value computing section 92 determines the light control reference value Wave using Equation (6). On the other hand, the scene change detection section 101 calculates the scene change SC using Equation (19). Then, the process proceeds to step S103.

In step S103, the light control rate computing section 71 calculates the backlight luminance K corresponding to the light control reference value Wave. Specifically, the light control rate computing section 71 calculates the limit light control rate αlim by substituting Equation (16) using the limit correction amount Glim that is obtained from Equation (17), and then calculates the backlight luminance K by substituting Equation (18) using the limit light control rate αlim. Then, the process proceeds to step S104.

In step S104, the light control rate filter section 95 executes filtering on the backlight luminance K. Specifically, the light control rate filter section 95 executes filtering, between the adjacent frames, on the backlight luminance K that is obtained for each frame on the basis of the backlight luminance filter coefficient p that is acquired from the backlight luminance filter coefficient calculation section 102. In this case, the light control rate filter section 95 uses a transfer function shown in Equation (27). Thus, the filtered backlight luminance Kflt is obtained. When the above process is completed, the process proceeds to step S105.

In step S105, the enhanced brightness correction amount computing section 65 and the enhanced saturation correction amount computing section 86 calculate the image correction amount Gy on the basis of the backlight luminance Kflt (light control rate αflt) that is filtered in the light control rate filter section 95. That is, the enhanced brightness correction amount G4' and the enhanced saturation correction amount Gc1 are calculated. Specifically, the enhanced brightness correction amount computing section 65 acquires the light control rate αflt that is filtered in the light control rate filter section 95 and calculates the enhanced brightness correction amount G4' by substituting Equation (20) using the light control rate αflt. In addition, the enhanced saturation correction amount computing section 86 calculates the enhanced saturation correction amount Gc1 by substituting Equation (26) using the light control rate αflt. When the above process is completed, the process proceeds to step S106.

In step S106, the image correction amount filter section (the brightness correction amount filter section 96 and the saturation correction amount filter section 97) executes filtering on the image correction amount Gy. Specifically, the image correction amount filter section executes filtering on the image correction amount Gy that is obtained for each frame on the basis of the image correction amount filter coefficient q that is acquired from the image correction amount filter coefficient calculation section 103. In this case, the image correction amount filter section uses the transfer function shown in Equation (28). Thus, the filtered image correction amount Gyflt is obtained. Specifically, the brightness correction amount filter section 96 executes filtering, between the adjacent frames, on the enhanced brightness correction amount G4' that is obtained for each frame, and the saturation correction amount filter section 97 executes filtering, between the adjacent frames, on the enhanced saturation correction amount Gc1 that is obtained for each frame. When the above process is completed, the process proceeds to step S107. Note that the processes of step S102 to step S106 are executed after each frame image has been input.

In step S107, light control and image correction are executed using the backlight luminance Kflt and the image correction amount Gyflt. Specifically, the light source control section 48 executes light control on the backlight 32 on the basis of the backlight luminance Kflt. In addition, the brightness correction execution section 66 executes brightness correction on the image data on the basis of the enhanced brightness correction amount G4flt, while the saturation correction execution section 87 executes saturation correction on the image data on the basis of the enhanced saturation correction amount Gc1flt. Then, the image display signal generating section 45 generates an image display signal corresponding to the image data, for which image correction is executed, and then sends the generated image display signal to the display panel 30. When the above processes are completed, the process escapes the flow. Note that the process of step S107 is executed on the next frame image.

According to the above described processes, when backlight dimming for power saving and image correction for compensating for the backlight dimming are performed, it is possible to effectively improve a flicker and/or a response, and it is possible to appropriately prevent breaking of a balance between light control and image correction. Thus, it is possible to display an image with high quality.

Second Embodiment

The following will describe a second embodiment of the invention. In the above described first embodiment, a plurality of filtering processes are executed in a plurality of circuits (processing sections). In the second embodiment, a plurality of filtering processes are executed using a single circuit. Specifically, in the second embodiment, by switching input/output signals of a filter computing circuit and filter coefficients used in the filter computing circuit, filtering is time sequentially executed on the backlight luminance K and on the image correction amount Gy in the single filter computing circuit. That is, the single filter computing circuit serves not only as a circuit that executes filtering on the backlight luminance K but also as a circuit that executes filtering on the image correction amount Gy, thus sequentially executing filtering.

FIG. 9G is a block diagram that schematically shows the configuration of the filtering section according to the second embodiment. The filtering section 120 includes a filter computing circuit 110, an input switch circuit 111, a setting switch circuit 112, a previous frame value save/switch circuit 113, an output switch circuit 114, and a filter computing control section 115. Note that the filtering section 120 is applied to the above described image processing engine 15. Specifically, the filtering section 120 is applied in place of the light control rate filter section 95, the brightness correction amount filter section 96 and the saturation correction amount filter section 97.

The input switch circuit 111 executes switching so that any one of the backlight luminance K and the image correction amount Gy is input to the filter computing circuit 110. The setting switch circuit 112 acquires the backlight luminance filter coefficient p and the image correction amount filter coefficient q from the backlight luminance filter coefficient calculation section 102 and the image correction amount filter coefficient calculation section 103, and executes switching so that any one of these backlight luminance filter coefficient p and image correction amount filter coefficient q is input to the filter computing circuit 110. The previous frame value save/switch circuit 113 acquires the backlight luminance Kflt and the image correction amount Gyflt of the previous frame, which have been processed in the filter computing circuit 110, and stores these previous backlight luminance Kflt and image correction amount Gyflt, and then executes switching so that any one of these previous backlight luminance Kflt and image correction amount Gyflt is input to the filter computing circuit 110. The output switch circuit 114 executes switching so that any one of the backlight luminance Kflt and the image correction amount Gyflt is output from the filter computing circuit 110.

Figure 9:
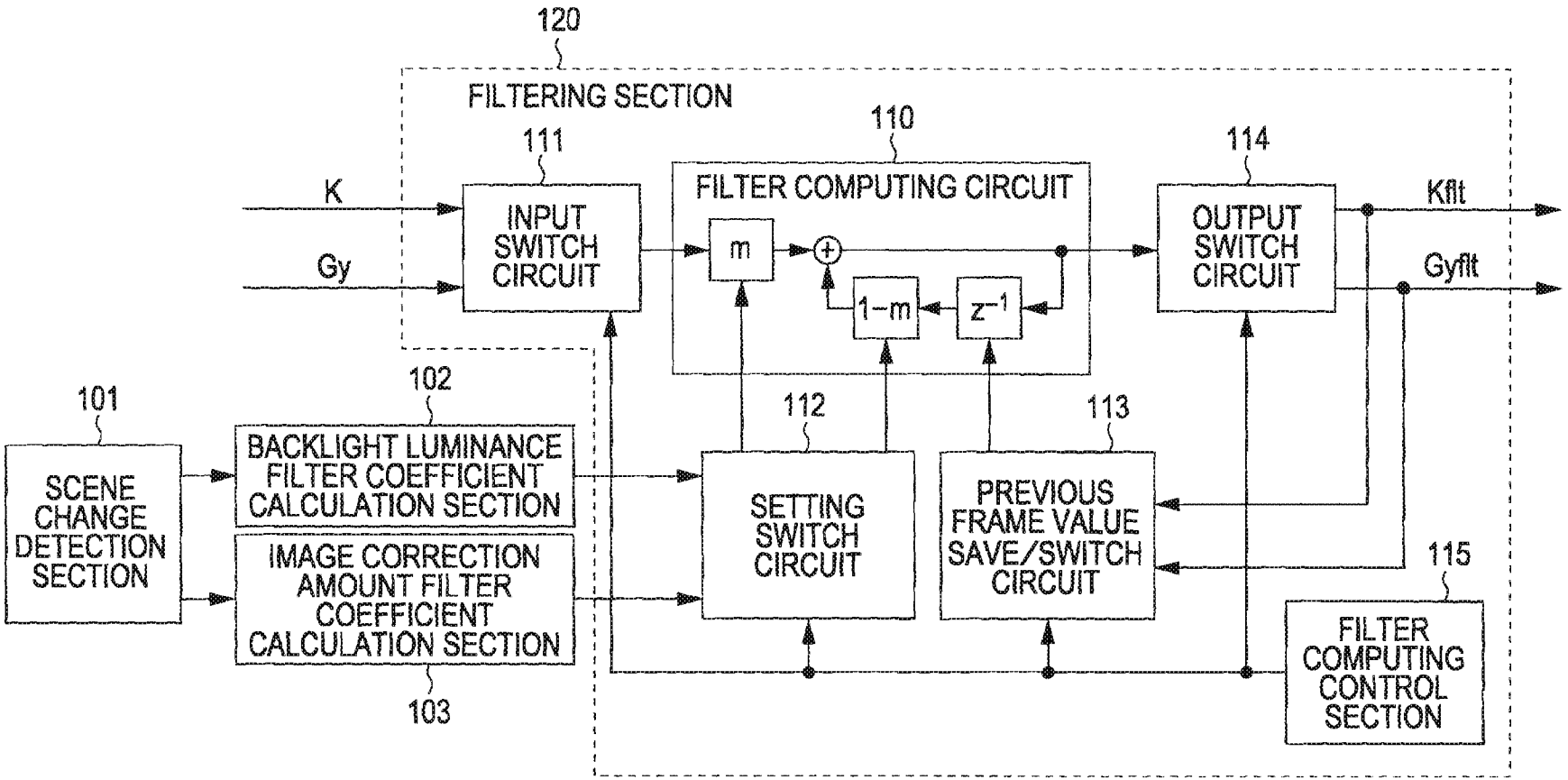
FIG. 9 is a block diagram that schematically shows the configuration of a filtering section according to a second embodiment of the invention.

The filter computing circuit 110 executes filtering on the input backlight luminance K and the input image correction amount Gy using the corresponding filter coefficients (the backlight luminance filter coefficient p or the image correction amount filter coefficient q). The filter computing circuit 110 outputs the backlight luminance Kflt and the image correction amount Gyflt through the above filtering process. Note that "m" in FIG. 9 is a value corresponding to any one of the backlight luminance filter coefficient p and the image correction amount filter coefficient q. In addition, the filter computing control section 115 controls switching in the input switch circuit 111, the setting switch circuit 112, the previous frame value save/switch circuit 113, and the output switch circuit 114.

As described above, according to the second embodiment, the filters for the backlight luminance K and the image correction amount Gy are integrated (that is, configured by a single circuit), and input/output signals and filter coefficients are switched, so that it is possible to effectively reduce circuit size.

Note that, in the above description, an example in which one filter is used for each of the backlight luminance K and image correction amount Gy is shown; however, the image correction includes a plurality of corrections, such as brightness correction and saturation correction, (for example, level correction and contrast correction) as described above and, hence, it is possible to further effectively reduce circuit size by switching the filters for these corrections.

ALTERNATIVE EXAMPLES

In the above described example, the embodiments in which the process is executed using the light control reference value Wave as the reference input gray scale value is shown, but the reference input gray scale value is not limited to it. In another example, the process may be executed using the average luminance Yave as the reference input gray scale value in place of the light control reference value Wave.

In addition, the above described calculations are basically presumed to be performed in a circuit between the adjacent frames of a dynamic image, but the calculations may be executed through software processing. For example, the function implemented in the components of the image processing engine 15 may be implemented through an image display program that is executed by the CPU (computer) 11. Note that the image display program may be stored in the hard disk 14 or in the ROM 12 in advance, or the image display program may be externally supplied through a computer readable recording medium, such as the CD-ROM 22, and then the image display program read by the CD-ROM drive 16 may be stored in the hard disk 14. In addition, the image display program may be stored in the hard disk 14 by accessing to a server, or the like, that supplies the image display program and then downloading the data through a network device, such as an internet.

Furthermore, some of functions may be implemented in a hardware circuit the other functions, which are not implemented in the hardware circuit, may be implemented by software. For example, histograms, $\Sigma Y$, $\Sigma|cb|$, $\Sigma|cr|$, $\Sigma F(Y)$, $\Sigma|Fc(cb)|$, $\Sigma|Fc(cr)|$, and the like, which are processed for pixels, may be implemented in the circuit, and average values, light control rates, image correction amounts, which are calculated for each frame, may be executed by the CPU 11 through software processing between the adjacent frames. Moreover, when a dynamic image is converted in advance to dimmed data or a corrected dynamic image before display, all the functions may be executed through software processing.

Electronic Apparatuses

Figure 10A:
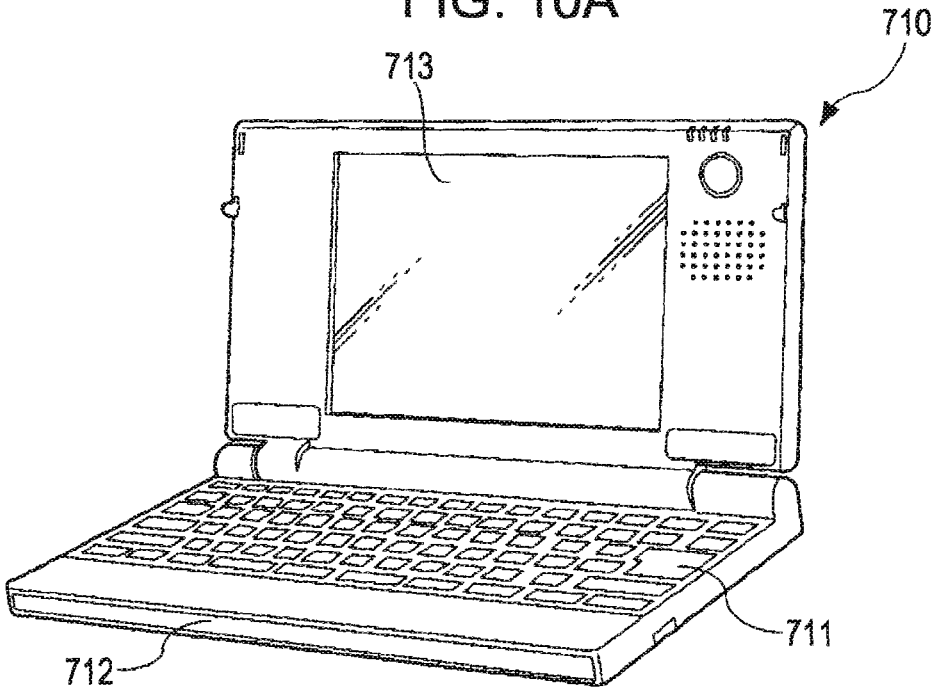
FIG. 10A and FIG. 10*b* are views that show specific examples of electronic apparatuses to which the image display device is applicable.
Figure 10B:
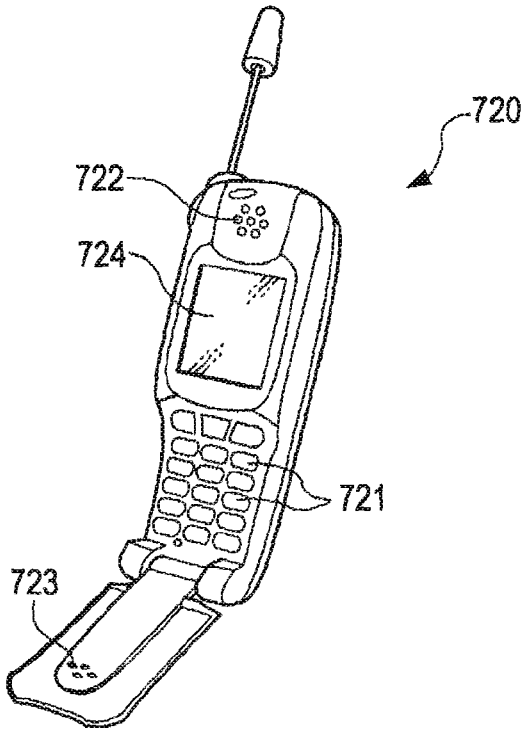

The following will describe specific examples of electronic apparatuses to which the image display device 1 according to the above described embodiments are applicable with reference to FIG. 10A and FIG. 10B.

At first, an example in which the image display device 1 according to the above described embodiments are applied to a display portion of a mobile personal computer (that is, a laptop personal computer) will be described. FIG. 10A is a perspective view that shows the configuration of the personal computer. As shown in the drawing, the personal computer 710 includes a body portion 712 having a keyboard 711 and a display portion 713 to which a liquid crystal device 100 according to the aspects of the invention is applied.

Subsequently, an example in which the image display device 1 according to the above described embodiments is applied to a display portion of a mobile telephone will be described. FIG. 14B is a perspective view that shows the configuration of the mobile telephone. As shown in the drawing, the mobile telephone 720 includes a plurality of operation buttons 721, an earpiece 722, a mouthpiece 723, and a display portion 724 to which the liquid crystal device 100 according to the aspects of the invention is applied.

Note that the electronic apparatus to which the image display device 1 according to the aspects of the invention is applicable is not limited to the above described examples.

What is claimed is:

1. An image display device that corrects image data, which are used for displaying an image, using a gray scale value assigned to each pixel and that also controls a source light luminance of a light source, comprising:

an image processing engine including a scene change detection section that detects a change of scene of the input image data;

an image correction section that corrects the image data;

a source light luminance control section that controls the source light luminance; and a time characteristic control section that changes a first time characteristic of a change in the source light luminance and a second time characteristic of an image correction amount by which both image data correction and change in source light luminance are directly based on the change of scene, the first and second time characteristics each being proportional to the change of scene, and that executes a process on the basis of the first time characteristic and the second time characteristic, wherein the first and second time characteristics are calculated independently from each other, the time characteristic control section executes filtering on the source light luminance for each frame using the first time characteristic as a filter coefficient and executes filtering on the image correction amount for each frame using the second time characteristic as a filter coefficient, and the time characteristic control section executes filtering on the source light luminance for each frame on the basis of the first time characteristic, calculates an image correction amount for each frame using the source light luminance that is filtered on the basis of the first time characteristic, and executes filtering on the calculated image correction amount on the basis of the second time characteristic.

2. The image display device according to claim 1, wherein the time characteristic control section sets the first time characteristic and the second time characteristic so that the first time characteristic differs from the second time characteristic.

3. The image display device according to claim 2, wherein the time characteristic control section sets the first time characteristic and the second time characteristic so that a change in the source light luminance is slower in terms of time than a change in the image correction amount.

4. The image display device according to claim 1, wherein the time characteristic control section includes:

a filter computing circuit that executes filtering; and a switching device that switches input/output signals of the filter computing circuit and filter coefficients, which are used by the filter computing circuit, wherein the time characteristic control section executes the switching by means of the switching device, so that filtering on the source light luminance and filtering on the image correction amount are time sequentially executed in the filter computing circuit.

5. An electronic apparatus comprising:

the image display device according to claim 1; and a power supply unit that supplies the image display device with voltage.

6. The image display device according to claim 1, wherein the time characteristic control section includes a light control rate filter section and an image correction amount filter section, the light control rate filter section acquires the first time characteristic and filters the source light luminance between adjacent frames for each frame, and the image correction amount filter section acquires the second time characteristic and filters the calculated image correction amount between adjacent frames for each frame, and the time characteristic control section sets the first time characteristic and the second time characteristic so that the scene change becomes larger such that the source light luminance and the image correction amount changes quickly in time, while at the same time, the first time characteristic and the second time characteristic are set so that a change in the source light luminance is slower in terms of time than a change in the image correction amount.

7. The image display device according to claim 1, wherein the first and second time characteristics are each directly proportional to the change of scene.

8. The image display device according to claim 1, wherein for a same change of scene, the second time characteristic is larger than the first time characteristic.

9. An image display method that corrects image data, which are used for displaying an image, using a gray scale value assigned to each pixel and that also controls a source light luminance of a light source, comprising:

detecting a change of scene of the input image data;

correcting the image data;

controlling the source light luminance;

changing a first time characteristic of a change in the source light luminance and a second time characteristic of an image correction amount with a time characteristic control section by which both image data correction and change in source light luminance are directly based on the change of scene, the first and second time characteristics each being proportional to the change of scene and being calculated independently from each other;

filtering the source light luminance for each frame on the basis of the first time characteristic;

calculating an image correction amount for each frame using the source light luminance that is filtered on the basis of the first time characteristic; and filtering the calculated image correction amount based on the second time characteristic.

10. The image display method according to claim 9, wherein for a same change of scene, the second time characteristic is larger than the first time characteristic.

11. The image display method according to claim 9, wherein the time characteristic control section includes a light control rate filter section and an image correction amount filter section, the light control rate filter section acquires the first time characteristic and filters the source light luminance between adjacent frames for each frame, and the image correction amount filter section acquires the second time characteristic and filters the calculated image correction amount between adjacent frames for each frame, and the time characteristic control section sets the first time characteristic and the second time characteristic so that the scene change becomes larger such that the source light luminance and the image correction amount changes quickly in time, while at the same time, the first time characteristic and the second time characteristic are set so that a change in the source light luminance is slower in terms of time than a change in the image correction amount.

12. A non-transitory computer-readable recording medium comprising:

an image display program that executes a process to correct image data, which are used for displaying an image, using a gray scale value assigned to each pixel and that also executes a process to control a source light luminance of a light source, the image display program comprising the instructions for causing a computer to:

detect a change of scene of the input image data;

correct the image data;

control the source light luminance;

change a first time characteristic of a change in the source light luminance and a second time characteristic of an image correction amount with a time characteristic control section by which both image data correction and change in source light luminance are directly based on the change of scene, the first and second time characteristics each being proportional to the change of scene and being calculated independently from each other;

filtering the source light luminance for each frame on the basis of the first time characteristic;

calculating an image correction amount for each frame using the source light luminance that is filtered on the basis of the first time characteristic; and filtering the calculated image correction amount based on the second time characteristic.

13. The non-transitory computer-readable recording medium according to claim 12, wherein for a same change of scene, the second time characteristic is larger than the first time characteristic.

14. The non-transitory computer-readable recording medium according to claim 12, wherein the time characteristic control section includes a light control rate filter section and an image correction amount filter section, the light control rate filter section acquires the first time characteristic and filters the source light luminance between adjacent frames for each frame, and the image correction amount filter section acquires the second time characteristic and filters the calculated image correction amount between adjacent frames for each frame, and the time characteristic control section sets the first time characteristic and the second time characteristic so that the scene change becomes larger such that the source light luminance and the image correction amount changes quickly in time, while at the same time, the first time characteristic and the second time characteristic are set so that a change in the source light luminance is slower in terms of time than a change in the image correction amount.

* * * * *